US009409751B2

(12) United States Patent
Comerford et al.

(10) Patent No.: US 9,409,751 B2
(45) Date of Patent: Aug. 9, 2016

(54) LIFTING DEVICE AND METHOD FOR CONCRETE ELEMENTS

(75) Inventors: Ernest Frederick Comerford, Glen Alpin (AU); Mark Andrew Rankin, Seven Hills (AU)

(73) Assignee: Obelix Holdings Pty Limited, North Sydney, New South Wales (AU)

( * ) Notice: Subject to any disclaimer, the term of this patent is extended or adjusted under 35 U.S.C. 154(b) by 203 days.

(21) Appl. No.: 13/125,593

(22) PCT Filed: Oct. 23, 2009

(86) PCT No.: PCT/AU2009/001401
§ 371 (c)(1),
(2), (4) Date: Jul. 13, 2011

(87) PCT Pub. No.: WO2010/045692
PCT Pub. Date: Apr. 29, 2010

(65) Prior Publication Data

US 2011/0262263 A1 Oct. 27, 2011

(30) Foreign Application Priority Data

Oct. 23, 2008 (AU) ..... 2008905461

(51) Int. Cl.
*B66C 1/54* (2006.01)
*B66C 1/66* (2006.01)
*E04G 21/14* (2006.01)

(52) U.S. Cl.
CPC ..... *B66C 1/666* (2013.01); *E04G 21/142* (2013.01)

(58) Field of Classification Search
CPC ..... B66C 1/54; B66C 1/56; B66C 1/66; B66C 1/666; E21B 31/20; E04G 21/142; E04G 15/04; B28B 23/005; B28B 23/0056
USPC ..... 294/95, 97, 86.25, 89, 215; 52/125.5
See application file for complete search history.

(56) References Cited

U.S. PATENT DOCUMENTS

| | | | | | |
|---|---|---|---|---|---|
| 718,066 | A | * | 1/1903 | McWilliams | 294/86.25 |
| 2,642,768 | A | * | 6/1953 | Ogburn | 411/53 |
| 2,719,747 | A | | 10/1955 | Layne | |
| 4,068,879 | A | | 1/1978 | Torbet et al. | |
| 4,948,089 | A | * | 8/1990 | Knodel et al. | 249/86 |
| 6,092,849 | A | | 7/2000 | Zambelli et al. | |

(Continued)

FOREIGN PATENT DOCUMENTS

| | | | |
|---|---|---|---|
| AU | 755585 | | 5/1999 |
| JP | 10095591 | A | 4/1998 |
| WO | WO2009121978 | | 10/2009 |

*Primary Examiner* — Gabriela Puig
(74) *Attorney, Agent, or Firm* — Bishop Diehl & Lee, Ltd.

(57) ABSTRACT

A lifting device (110) for concrete elements such as bridge beam and deck elements, panels and the like up to and beyond 1,000 tons (t) is described. The lifting device may be suitable for face and edge lifting of concrete elements that have a suitable cavity formed within or through them. The lifting device (110) may include a lifting eye (116) connected to an elongate member/shank (114) that has a flared end (122). A sleeve (126) about the shank (114) may be used to raise and lower the moveably attached wedges (124) to and from the flared end (122). In use the wedges (124) upon the flared end (122) prevent the withdrawal of the lifting device (110) from the cavity of the concrete element. A cavity former is also described that may be used in the casting of the concrete element to form a suitable cavity.

8 Claims, 15 Drawing Sheets

(56) References Cited

U.S. PATENT DOCUMENTS 6,109,587 A 8/2000 Peacock et al.
6,511,113 B1 * 1/2003 Kulage ..... 294/97
7,384,085 B2 * 6/2008 Steinhovden ..... 294/95
8,171,697 B2 * 5/2012 Zimmer et al. ..... 52/701

* cited by examiner

LIFTING DEVICE AND METHOD FOR CONCRETE ELEMENTS

BACKGROUND OF THE INVENTION

1. Field of the Invention

The present invention relates to methods and apparatuses for lifting and handling of concrete elements, examples of such are bridge beam and deck elements, slabs, piles, wall panels, concrete legs and floating concrete caisson structures of oil platforms, prestressed concrete structures in general and the like. In particular, the lifting and handling of concrete elements up to and greater than 1,000 tonnes (t). The invention may be applied to concrete elements as commonly found in the building, construction, concrete pre-casting, demolition and emergency rescue industries/application areas.

2. Description of the Art

Lifting and handling of concrete elements is typically done by use of a crane or other lifting machine which is connected via a rigging to one or a number of lifting inserts permanently embedded in the concrete element to be lifted. Examples of such lifting inserts/anchors are U.S. Pat. Nos. 4,000,591, 4,367,892, 4,386,486, 4,437,642 and 4,580,378. In addition protruding loops of cable, wire loop and reinforcing bar have also been used to provide a lifting insert/anchor for attachment. The crane rigging may attach to the lifting insert via (for example) a lifting clutch, shackle, hook, lifting eye or any suitable attachment means or combination of.

However permanently embedded lifting inserts must be suitably protected against corrosion in order that the integrity of the concrete element is maintained and/or if the lifting insert is to have some re-use. In addition lifting inserts are a significant cost factor in the manufacture and use of concrete elements.

One example of extensive use of lifting inserts/anchors is in the pre-cast manufacture of panels, slabs and pre-stressed bridge beams where the lifting inserts are embedded during the casting process. Once the concrete element has been cast in a pre-caster facility then the lifting inserts are used to lift the concrete element from the floor or from the moulding/casting form in which it is made. The concrete element panels are then typically placed on racks or stacked to allow the concrete to gain strength prior to being delivered to a construction site. The delivery to the construction site requires a lift onto a transporter and then a subsequent lifting and handling to position the concrete element in the construction project. The embedded lifting inserts remain in the concrete element and are of no further use.

If the concrete element is made by a tilt slab builder on the building construction site then the lifting inserts are often used in a single lift of the concrete element from the position in which it was cast into its final position in a building project. Again, the embedded inserts remain in the concrete element and are of no further use.

For lifting inserts typically used in concrete element manufacture the corrosion protection process has particular dangers if not properly treated, due to hydrogen embrittlement of a steel lifting insert, for example. Lifting inserts that are embrittled may unexpectedly fail during a lift of a concrete element, endangering workers in the proximity of the load. As a consequence, the use of expensive redundant permanent inserts and their attendant safety issues is a significant cost and risk to the building and construction industry.

Portable concrete road barriers often feature steel lifting inserts which are used to lift the road barriers numerous times over the course of their many years of use. The lifting inserts embedded in the upper faces of concrete road barriers are exposed to the elements which may promote corrosion and consequently affect the serviceability of the lifting insert over its service life.

Expansion bolts, screw fasteners and the like that may be used to secure items or structures to a concrete element are not suitable for the lifting and handling of concrete elements. Expansion bolts/fasteners are not suited for the weight of concrete elements and the dynamic tensile and shear loads experienced in their lifting and handling. Such systems as expansion bolts/fasteners at large dynamic loads of some tonnes may be prone to failure, for example, via thread stripping, inadequate pull-out cone and/or the expanding anchor fails. National standards for lifting and handling of concrete elements typically do not allow for the use of expansion screw bolts. In addition expansion bolts are typically not completely removable and designed for single use; the screw or bolt may be removed but the expanding anchor remains behind in the hole to corrode and prevent re-use of the hole.

None of these prior art devices and methods provides an entirely satisfactory solution to the provision of lifting and handling of concrete elements, nor to the ease of use and verification of a safe lifting operation.

SUMMARY OF THE INVENTION

The present invention aims to provide an alternative lifting device and method for concrete elements which overcomes or ameliorates the disadvantages of the prior art, or at least provides a useful choice.

In one form, the invention provides a lifting device for a concrete element comprising of an elongate member with a flared lower end and an upper end configured for an attachment means, a sleeve about the elongate member and one or more wedges moveably attached to a lower end of the sleeve. When the sleeve moves towards the flared end the one or more wedges are displaced/splayed outwardly. Preferably the wedges are displaced outwardly by a portion of the flared lower end of the elongate member. In use the one or more wedges engage at least a portion of a wall or an edge of a configured cavity in the concrete element so as to prevent withdrawal of the elongate member from the cavity in the concrete element. The configured cavity being shaped or otherwise adapted to receive the lower end of the lifting device as well as being suitable for the wedges, or other interference devices, to engage with. The attachment means may by way of example be a lifting eye, a lifting ring, a shackle bolt, a hook, a cable or a loop.

The lifting device may also be configured as a lifting clutch for a crane or other lifting machine.

Preferably the wedges or other interference devices are pivotably attached to a lower end of the sleeve. The wedges or otherwise May be pivotally attached via a pivot pin and corresponding terminal lugs on the sleeve lower end and the respective wedges.

Optionally the flared end is a frusta-conical cone or section and the elongate member may be a shank, rectangular or other suitable cross-section. The sleeve's cross-section may be cylindrical, elliptical, rectangular or an otherwise suitable cross-section or structure.

Optionally the elongate member and the sleeve of the lifting device may be adapted or otherwise configured to receive a safety element when the one or more wedges is positioned over a portion of the flared end of the elongate member. Preferably the safety element may be a safety pin adapted to be inserted through concentric holes within the elongate member and the sleeve.

Optionally the upper end of the sleeve is configured or adapted to prevent use, access or block the attachment means when the wedges are not over a portion of the flared lower end of the elongate member. Preferably the upper end of the sleeve is a safety cap.

A further form of the invention provides a former comprising of a tube portion and a closed base end portion with one or more flared walls. The former may be used to form a suitably configured cavity in a concrete element during the casting of the concrete element. Alternatively a suitably configured cavity may be formed by drilling, cutting, percussion means, a jackhammer or other techniques common to the working of concrete elements.

In an alternate form the invention may provide a method for lifting concrete elements by a lifting device, including the steps of securing the lifting device to a concrete element by: configuring a cavity in the concrete element to receive the lower end of the lifting device, inserting the lower end of the lifting device into the cavity and then causing or otherwise actuating the one or more wedges at the lower end of the lifting device to engage a flared end of an elongate member of the lifting device and a portion of a wall or a edge of the configured cavity. The lifting device may then be attached to a lifting machine for lifting and/or handling the concrete element. Optionally the method for lifting may include one or more safety steps to prevent lifting of the concrete element until the lifting device is secured to the concrete element. Preferably a safety step may be the step of attaching or inserting a safety element to the lifting device. Where the safety element prevents the removal of the lifting device from the configured cavity of the concrete element. A second, optional safety step may be preventing attachment of the lifting machine or crane to the lifting device until the lifting device is secured to the concrete element, preferably by the use of a safety cap.

Further forms of the invention are as set out in the appended claims and as apparent from the description.

DISCLOSURE OF THE INVENTION

Brief Description of the Drawings

The description is made with reference to the accompanying drawings; of which:

FIGS. 5 to 8 are partial cross-sectional views of FIGS. 1 to 4.

DETAILED DESCRIPTION OF THE PREFERRED EMBODIMENTS

Figure 1:
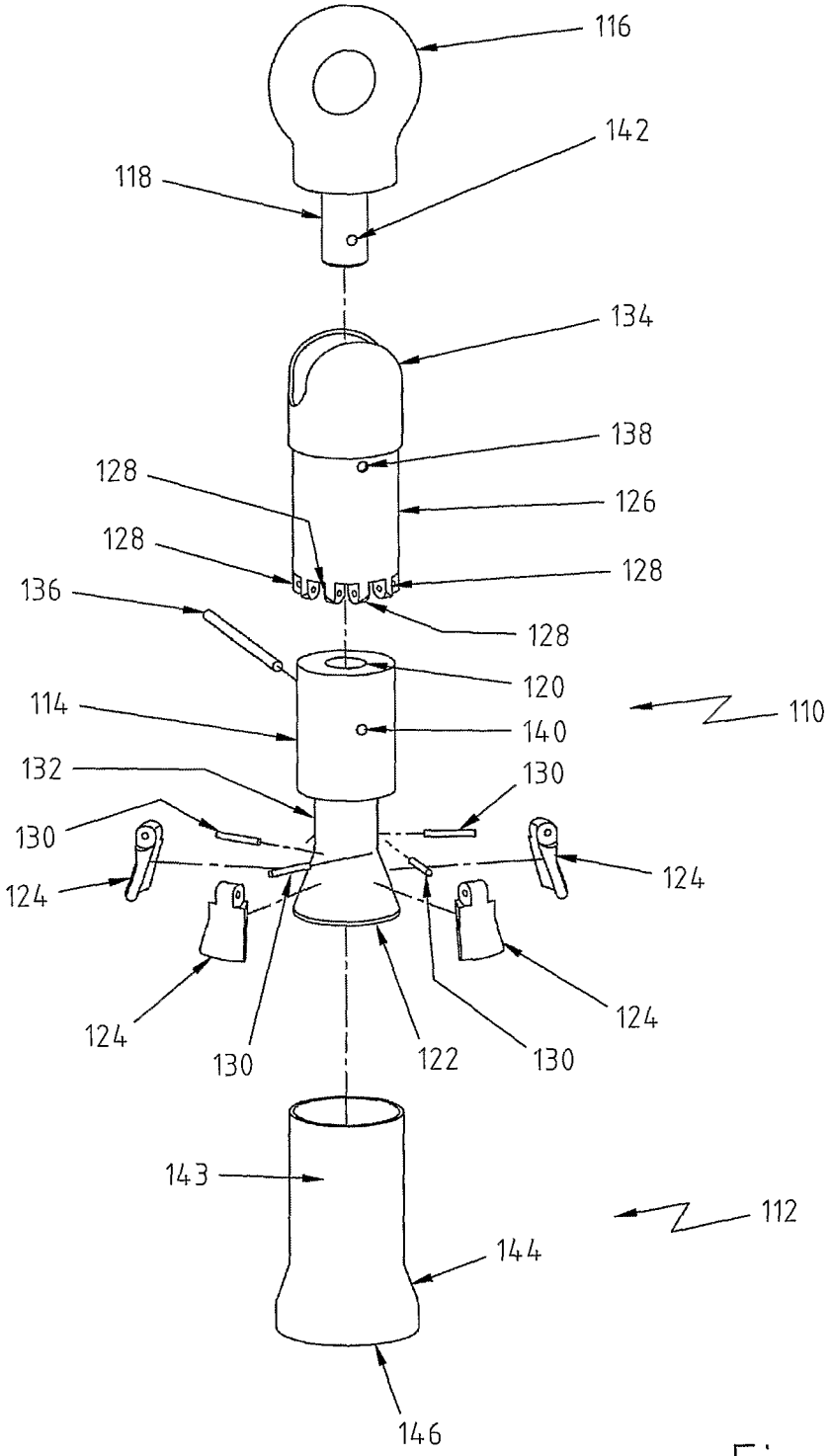
FIG. 1 is a schematic of an exploded perspective view of a lifting device and a cavity former in an embodiment of the present invention.

FIG. 1 schematically shows an exploded perspective view of an embodiment of a lifting device 110 and a cavity former 112 that may be used in lifting concrete elements. The word "concrete element" in the following detailed description and claims is taken to include one or more of: bridge beam and deck elements, slabs, piles, wall panels, concrete legs and floating concrete caisson structures of oil platforms, prestressed concrete structures and the like in general as well as concrete structures up to and beyond 1,000 tonnes (t).

The lifting device 110 may have an elongate member 114 which in this embodiment is a shank 114 that may be connected at the elongate member's 114 upper end to a lifting eye 116 as an attachment means 116 to the rigging of a crane or other lifting machine (not shown). The attachment means 116 may also be any other structure suitable for connecting a lifting device to the rigging of a crane, for example: a lifting ring, a shackle bolt, a hook, a cable or a loop. The lifting eye 116 may be secured to the elongate member 114 by a threaded shaft 118 which is screwed into the corresponding threaded hole 120 of the elongate member 114. Alternatively the lifting eye 116 may be cast, or otherwise constructed, with the elongate member 114 to form one piece.

The lower end of the elongate member 114 may have a flared end 122 which is shown as a frusta-conical cone 122 in FIG. 1. In alternate embodiments the flared end 122 may be flared in a curved fashion, rather than the straight profile of the cone shown. This may be to suit the interaction of the wedges 124 or other interference devices 124 with the flared end 122. The interaction between the flared end 122 and the wedges 124 is described in detail below with respect to FIGS. 2 to 8. A sleeve 126 may have terminal lugs 128 at its lower end to moveably attach the pendant wedges 124 by the use of pivot pins 130. It will be readily appreciated that any number of other moveable attachment mechanisms for the wedges 124 to the sleeve 126 may be designed and applied by a person skilled in the art. The sleeve 126 is shaped and/or configured to be able to slide up and down the elongate member 114, in the example of FIG. 1 the sleeve is cylindrical.

The elongate member 114 may also have a recess 132 or profiling to the elongate member 114 to allow the wedges to hang within as to be described in detail with respect to FIGS. 2 to 8 below.

The sleeve 126 may also have at its upper end an optional safety cap 134 that operates to prevent access to, use or block the lifting eye 116 until the lifting device 110 is safely engaged for lifting with a cavity in the concrete element; to be described in detail below with respect to FIGS. 2 to 8. An additional, optional safety feature may be the use of a safety pin 136 that may be inserted through the hole 138 in the sleeve 126, the hole 140 in the elongate member 114 and the hole 142 in the lifting eye 116 shaft 118. As for the safety cap 134, the operation of the safety pin is described below with respect to the same figures. The safety pin 136 may be in the form of a dowel, a rolled pin, a split pin or a specialised pin device that only allows or indicates authorised attachment by a certified rigger/dogger/supervisor. Alternatively the safety pin 136 and the respective holes 138, 140, 142 may be replaced by an alternate safety element such as a clip device (not shown) with respective grooves in the sleeve 126 and elongate member 114. In yet another alternate embodiment the safety element/pin 136 may be incorporated in an optional handle which may be attached at the upper end of the elongate member 114 or the sleeve 126. Further alternate safety elements are described below with respect to FIGS. 13 and 14. An optional handle with safety pin is described in detail below with respect to FIG. 15.

The materials and techniques used to construct the lifting device may be selected by a person skilled in the art of high compressive and tensile load mechanical devices. For example high tensile steels with appropriate ductility may be used. In addition case hardening and/or surface coatings on any components of the lifting device may be employed as appropriate.

The cavity former 112 example shown in FIG. 1 may be used when casting a concrete element so as to create a suitably configured cavity in the concrete former suitable for the lifting device 110 to be inserted and used. The casting in and other details of the cavity former are described in detail with respect to FIGS. 10 to 12. The cavity former 112 features a tube or bore portion 143 and a flared wall 144 towards the closed base 146 of the cavity former 112. The operation of the lifting device 110 with the cavity former 112 in casted concrete is described below in detail with respect to FIGS. 5 to 8. Alternate embodiments of the cavity former and other techniques for forming a suitable cavity or otherwise for the lifting device embodiments are also described below with respect to FIGS. 10 to 14.

Figure 2:
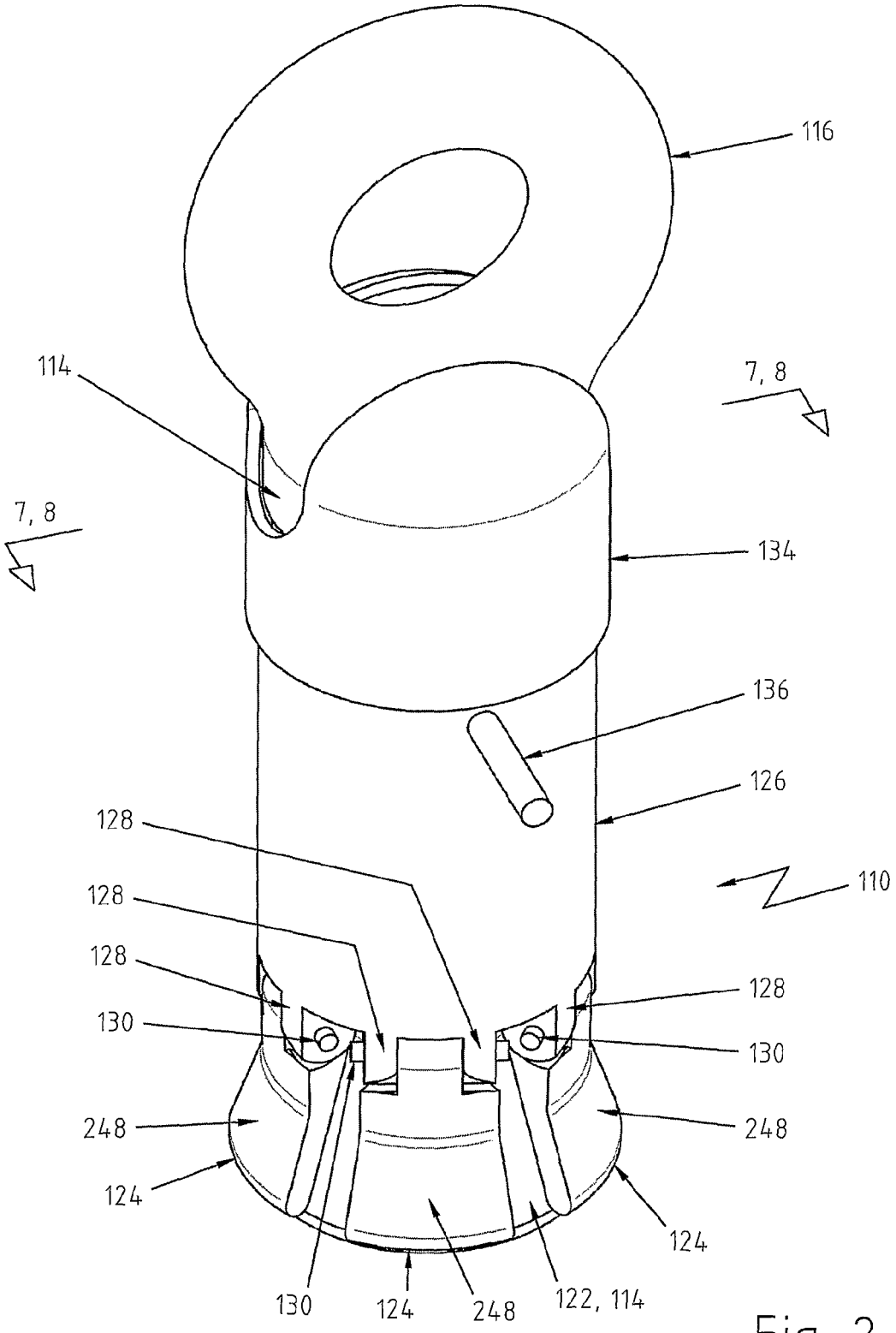
FIG. 2 is a schematic of a perspective view of the assembled lifting device of FIG. 1, with the sleeve lowered.

FIG. 2 is a schematic of a perspective view of the assembled lifting device 110 with sleeve 126 fully lowered and consequently the wedges 124 are shown resting upon the flared end 122 of the elongate member 114. The safety pin 136 is shown inserted through the respective holes 138, 140, 142 of the sleeve 126, elongate member 114 and lifting eye 116. The safety cap 134, as attached to the sleeve 126, is shown lowered and thus not obscuring the attachment means/lifting eye 116. An upper surface 248 of each wedge is shown with a profile which facilitates the operation of the wedge 124 (or other interference device) with a cavity in a concrete element; described further with respect to FIGS. 5 to 8.

Figure 3:
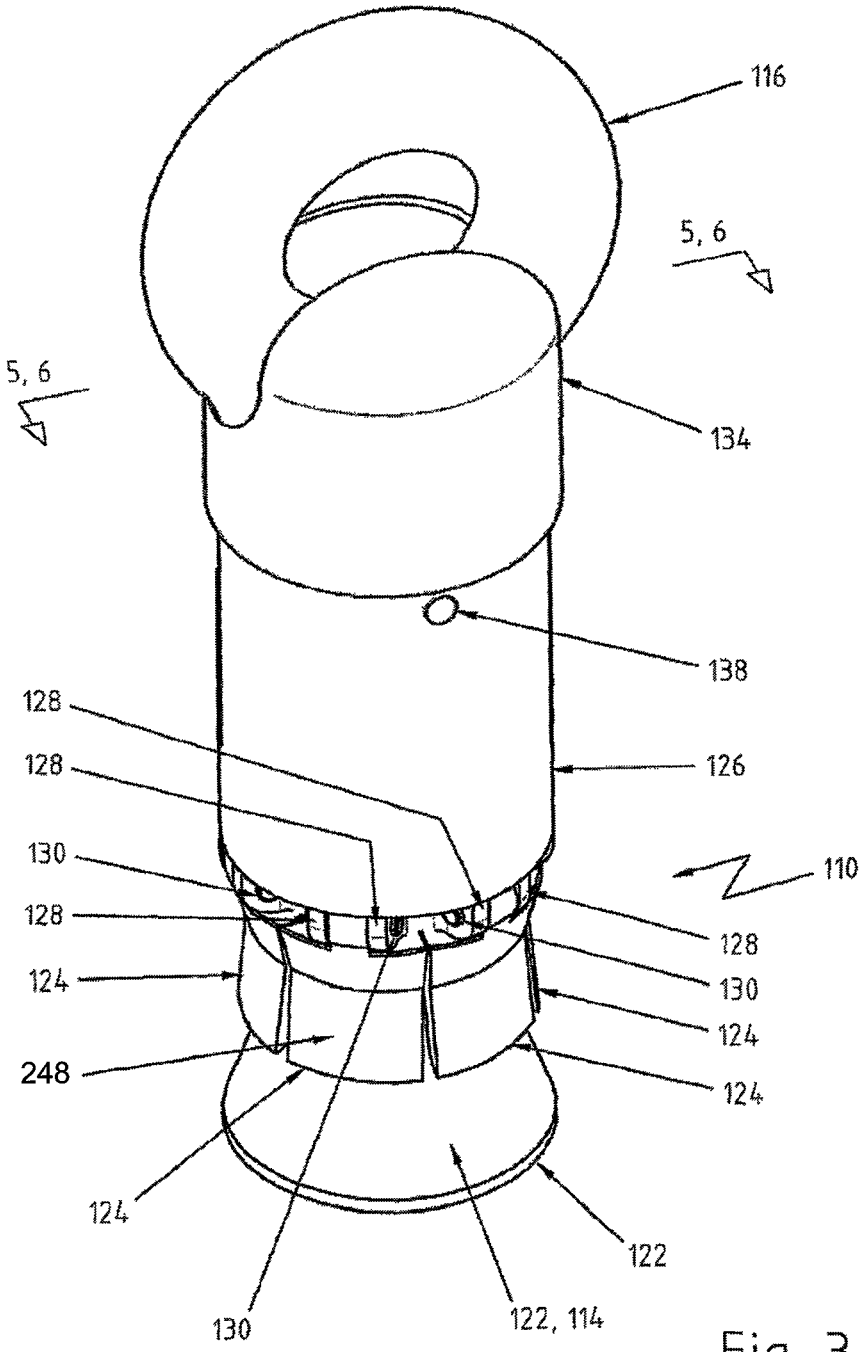
FIG. 3 is a schematic of a perspective view of the assembled lifting device of FIG. 1, with the sleeve raised.

FIG. 3 is a schematic of a perspective view of the assembled lifting device 110 with the sleeve 126 raised and consequently the wedges 124 are shown within the recess 132 of the elongate member 114. The safety pin 136 is absent as it cannot be inserted when the sleeve 124 is raised. The safety cap 134, with the sleeve 126 raised, is shown obscuring the lifting eye 116 to prevent attachment of a crane's rigging to the lifting device 110.

Figure 4:
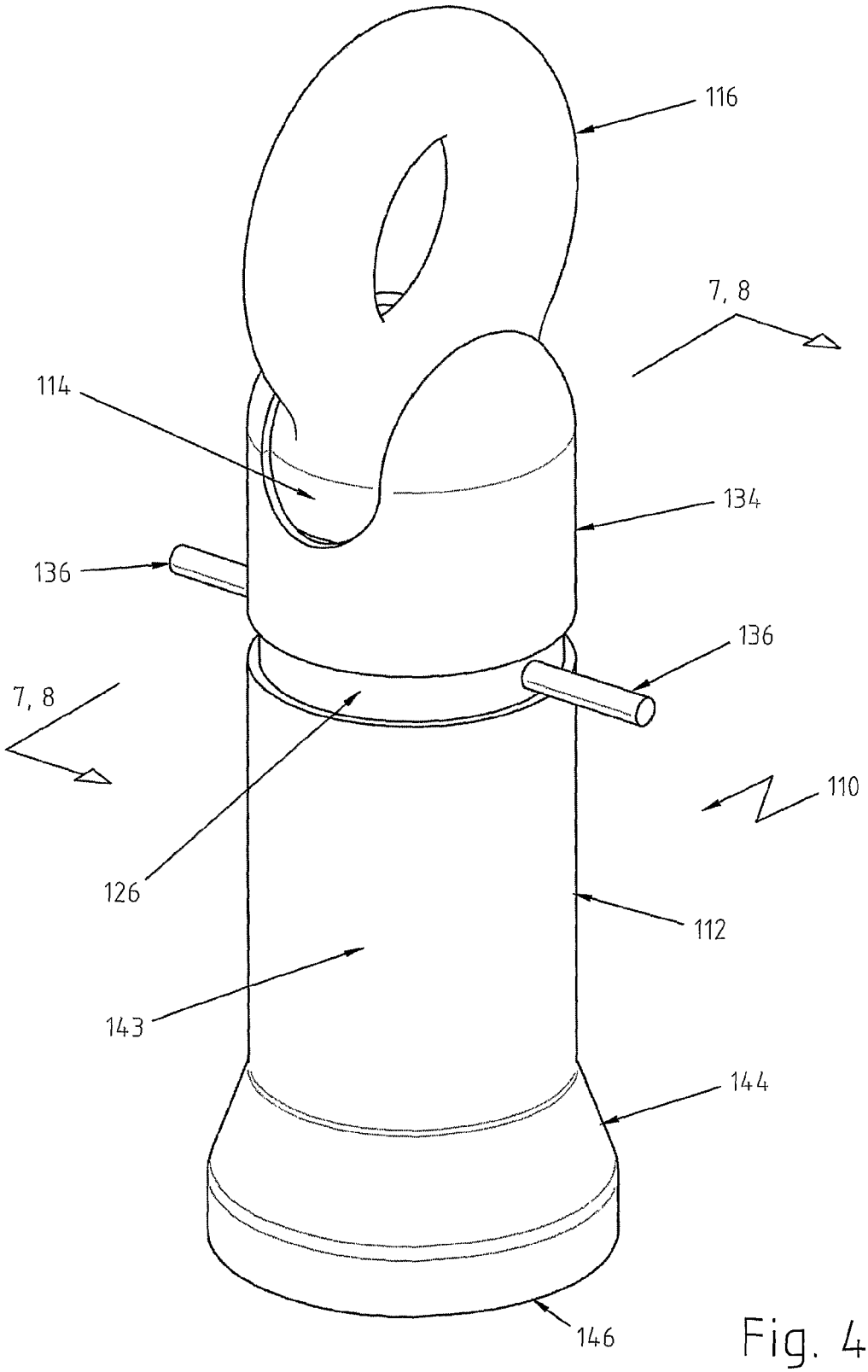
FIG. 4 is a schematic of a perspective view of the assembled lifting device and cavity former of FIG. 1, with the sleeve lowered.

FIG. 4 is a schematic of a perspective view of the assembled lifting device 110, sleeve 126 lowered, inserted within the cavity former 112.

Figure 5:
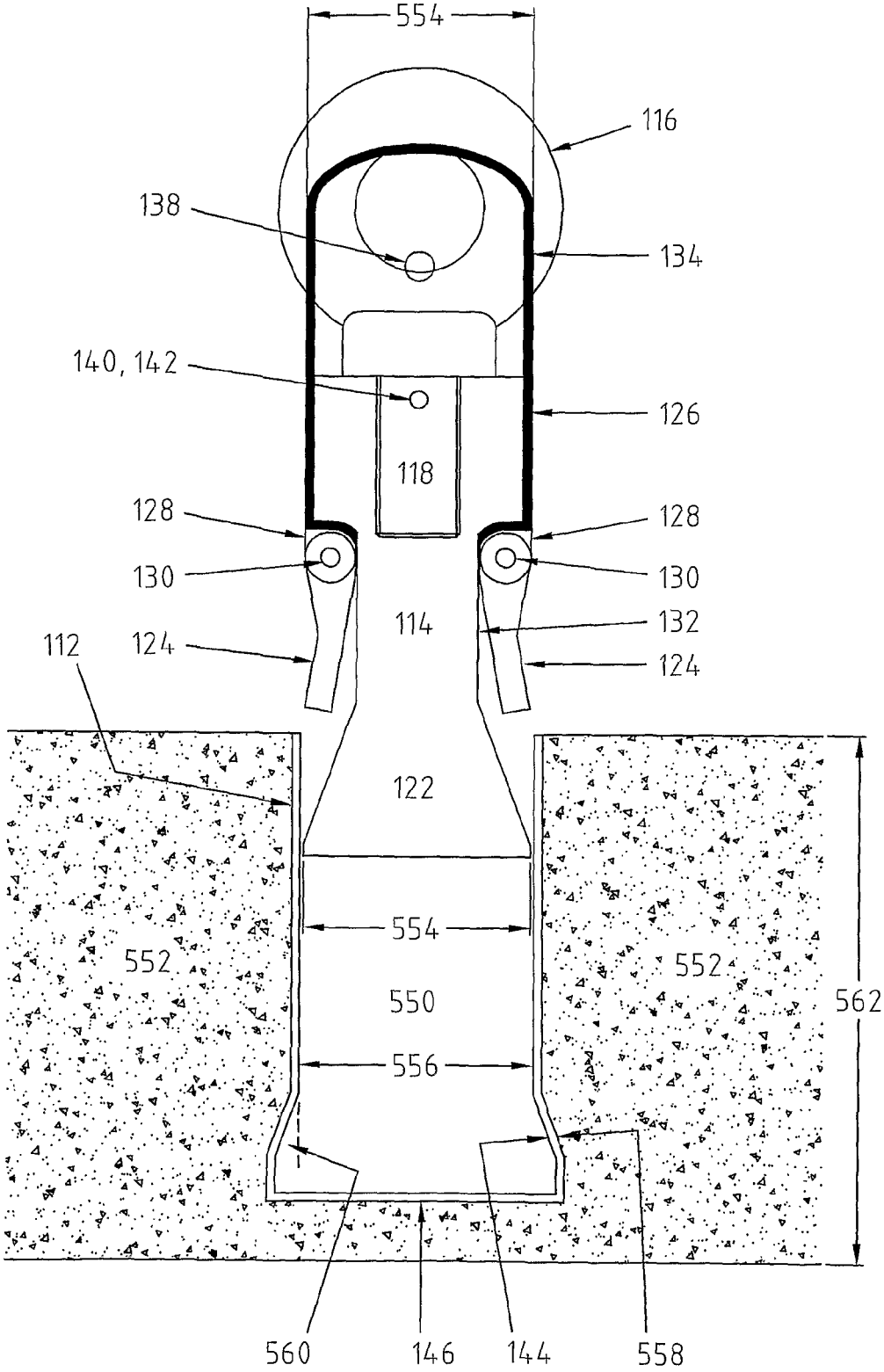
FIGS. 5 to 8 are schematic illustrations of the steps of inserting the lifting device of FIGS. 1 to 4 into a cavity of a concrete element and deploying it for lifting use.
Figure 6:
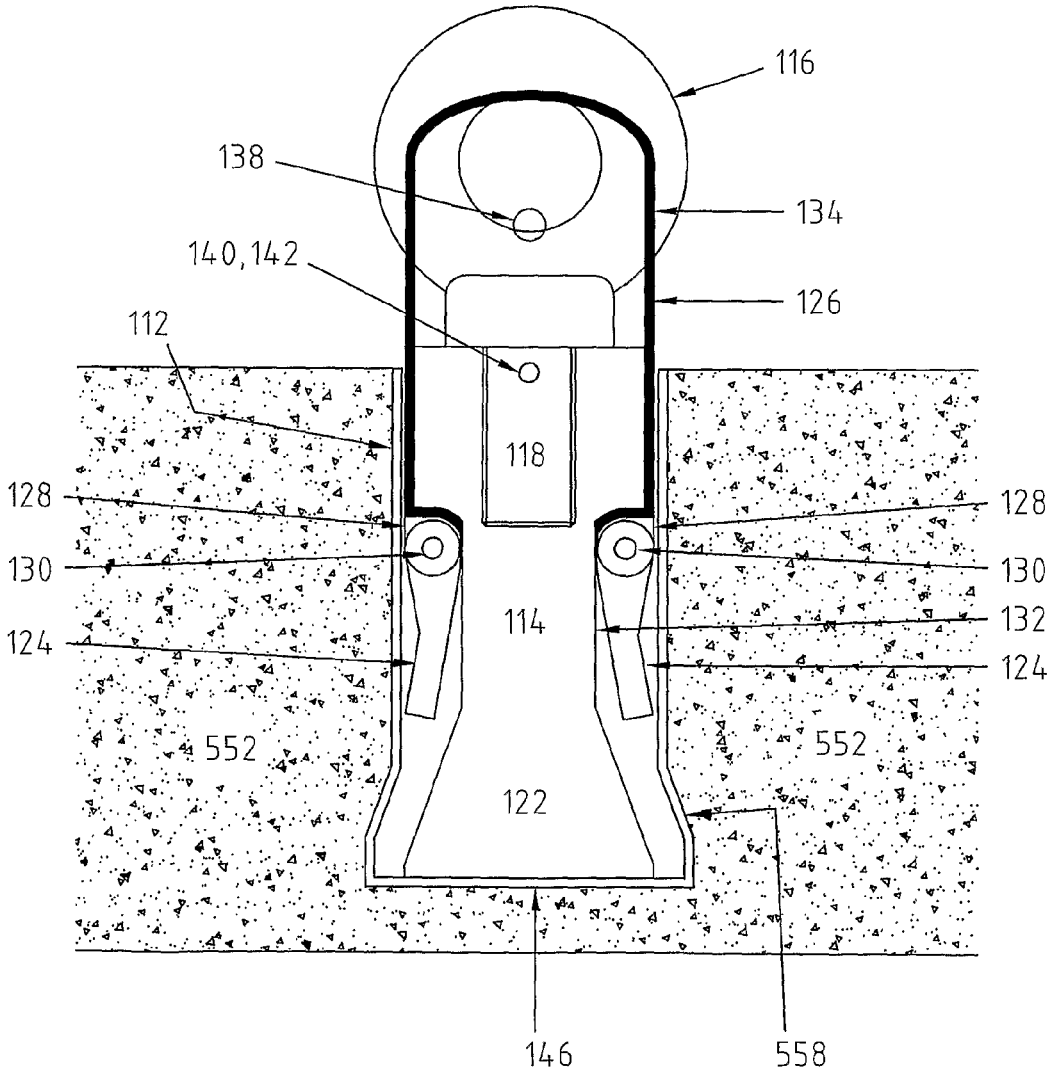
Figure 7:
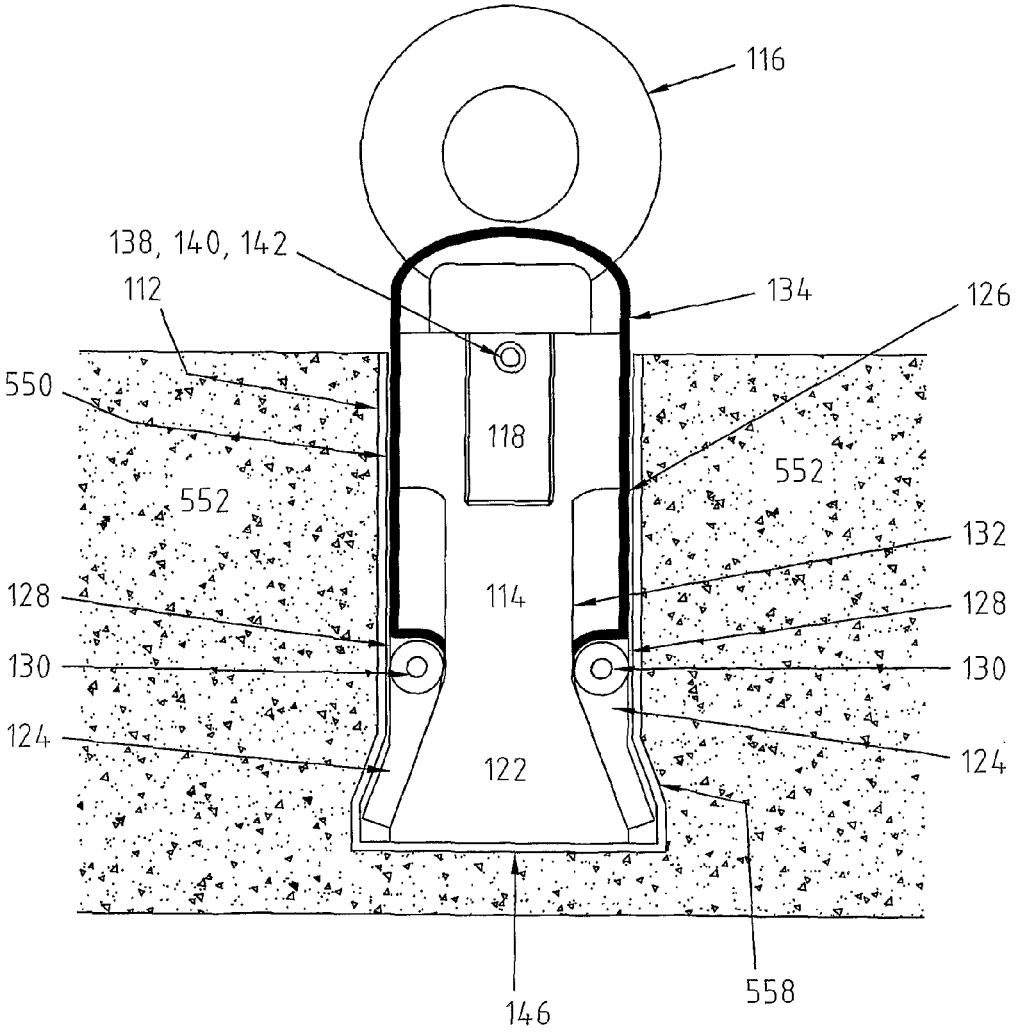
Figure 8:
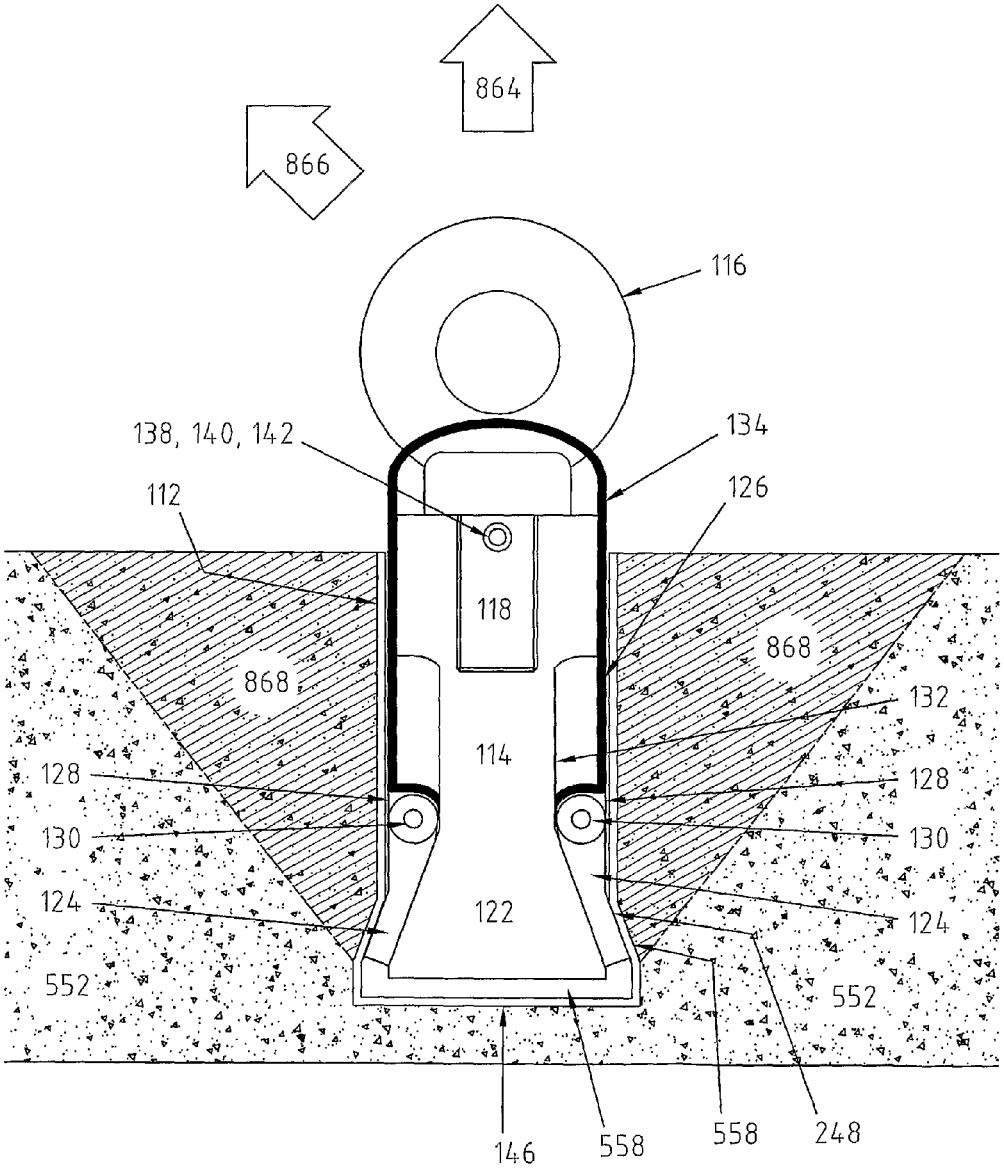

FIGS. 5 to 8 are schematic illustrations of inserting a lifting device into a cavity of a concrete element and deploying it for lifting use. FIGS. 5 to 8 are partial cross-sectional views of the lifting device 110 and cavity former of 112 of FIGS. 1 to 4 in order to better describe the operation of the lifting device. FIGS. 5 and 6 correspond to the partial cross-section along lines 5, 6-5, 6 of FIG. 3. FIGS. 7 and 8 correspond to the partial cross-section along lines 7, 8-7, 8 of FIGS. 2 and 4.

In the first illustrated step of FIG. 5 the lifting device 110 is shown with the sleeve 126 raised so that the wedges are partially at least within the recess 132 of the elongate member 114. The lifting device may then be inserted into the cavity 550 or bore, which in this example has been formed in a concrete element 552 by a cavity former 112 at casting. In FIG. 5 the outside diameter 554 of the sleeve 126 and the base of the flared end 122 of the elongate member 114 is 58 mm whilst the internal diameter 556 of the cavity bore 550 is 60 mm. The cavity bore 550 may also have a cavity flared end 558 where the angle 560 of the flared end to the line of the bore 550 in this example may be approximately 30 degrees and the depth 562 of the cavity flared end 558 is approximately 110 mm. The example lifting device as shown in FIG. 5 may be capable of lifting loads of up to and beyond 10 tonne in routine lifting work. Further comments to loads for the lifting device are made below with respect to FIGS. 8 and 9.

FIG. 6 illustrates a next step where the flared end 122 is at the base 146 of the cavity former 112 and the cavity 550. The sleeve 126 may then descend relative to the elongate member 114.

In FIG. 7 a further step is shown where the sleeve 126 has fully descended to allow the wedges 124 to rest upon the elongate member's 114 flared end 122 and occupy the cavity's flared end 558. The wedges 124 have now been displaced/splayed outwardly by the elongate member's flared end 122. The lifting eye 116 is now not obscured by the safety cap 134 and the holes 138, 140, 142 are aligned to receive the safety pin 136 if desired. Once the safety pin 136 or other safety element is inserted or applied, the lifting device cannot be removed from the cavity 550, 558 whilst the safety element 136 is in place. The lifting device 110 is now ready for attaching to the rigging of a crane and then lifting of the concrete element 552 may proceed. The lifting device 110 cannot be removed from the cavity 550, 558 of the concrete element 552 during a lift and not at all if the optional safety pin 136 remains inserted. In addition the attachment of the rigging to the lifting eye 116 also prevents the raising of the sleeve 126 due to the action of the safety cap 134, consequently whilst the crane is attached to the lifting device 110, it cannot be disengaged from the concrete element 552.

In FIG. 8 the lifting device 110 is shown in the position when the concrete element 552 is being lifted. The lifting device 110 may be pulled upwards, as indicated by arrow 864 or generally upwards as indicated by the alternate arrow 866 for partial shear and tensile loads to the lifting device 110. When the lifting device is pulled upwards 864, 866 the wedges 124 are raised by the elongate member's flared end 122 so that the upper surfaces 248 of the wedges 124 are up against the cavity's flared end wall 558. Thus the wedges 124 are engaged with the elongate member's flared end 122 and the flared wall 144. In an alternate embodiment a spring or otherwise assist device (not shown) may be incorporated within the base of the elongate member's flared end 122 to assist in setting the wedges 124 against the cavity's flared end wall 558 by pushing apart the flared end 122 from the base 146.

To release the lifting device from the concrete element 552 the steps described above with respect to FIGS. 5 to 8 are followed in reverse.

Without wishing to be bound by theory the factors affecting the load capacity of the lifting device include the volume of the pull out cone 868 of the concrete element that the lifting device is acting upon. In FIG. 8 a generalised area for the pull out cone volume 868 in cross section is shown in hatching. The pull out cone 868 volume of concrete may be acted upon by the upper surface 248 of the wedges 124 which are in turn acted upon by the elongate member's flared end 122 through to the lifting eye 116/attachment means for tensile and shear loading of the lifting device. Accordingly other factors affecting pull out cone volume and consequently the load capacity include the depth 562 of the lifting device in the concrete element 552, the effective angle 560 of the action of the wedges and elongate member's flared end 122 and the diameter of the cavity's flared end 558. In addition it will be readily appreciated that the concrete strength and any reinforcing used within it will affect the load capacity of the lifting device.

It will also be readily appreciated that the longitudinal axis/bore axis of the cavity 550 need not be perpendicular to the surface of the concrete element 552 as shown by way of example in FIGS. 5 to 8. In alternate embodiments the cavity 550 may be readily, alternately formed within the concrete element 552 at an angle in the range of 45 to 90 degrees between the bore axis and the surface of the concrete element. Further shallower angles (<45 degrees) for the cavity 550 may also be possible for concrete elements manufactured to accommodate a shallower angle cavity or for demolition and emergency rescue work where the final integrity of the concrete element is of minimal concern.

Figure 9:
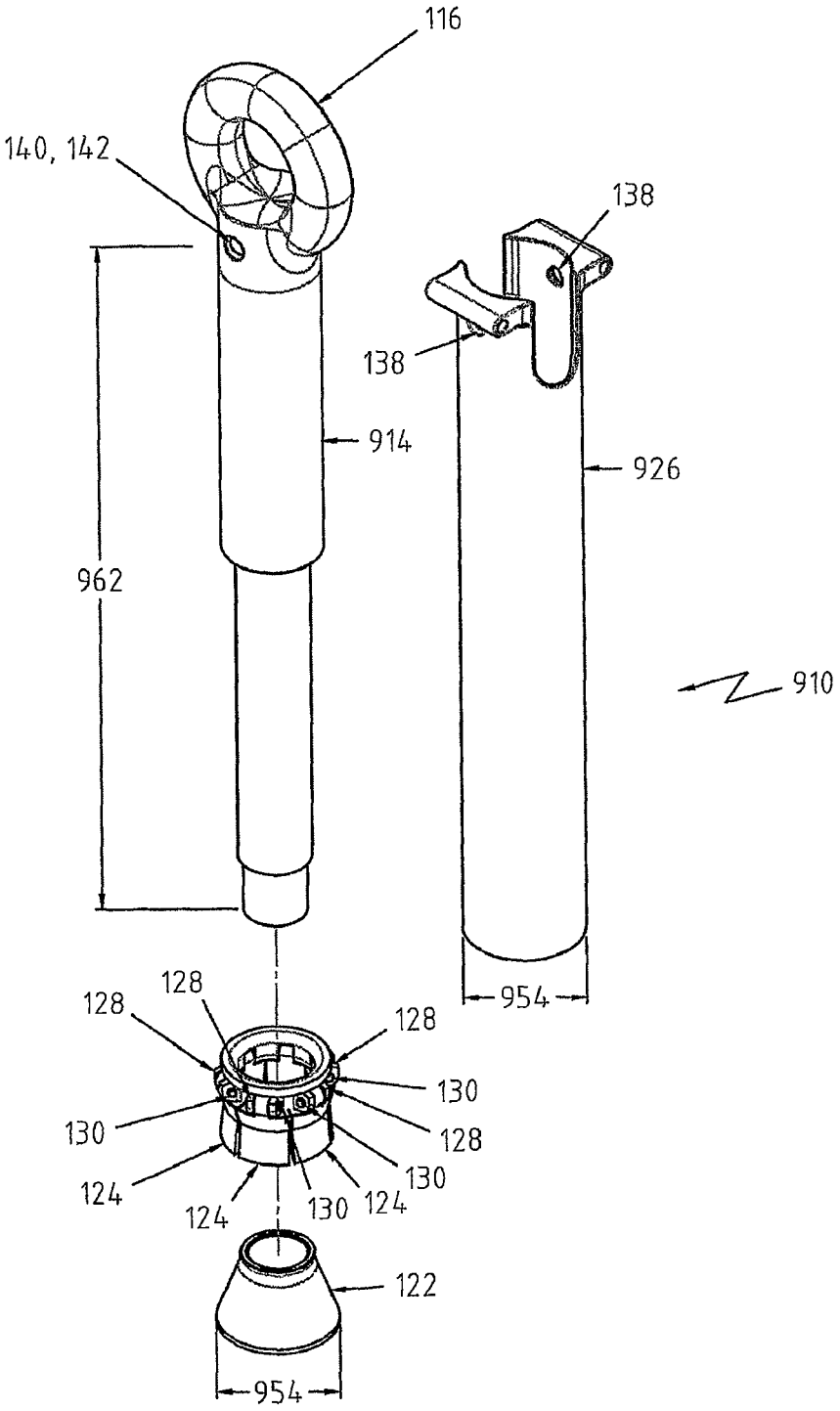
FIG. 9 is a schematic of an exploded perspective view of an alternate, 50 tonne, embodiment of the lifting device of FIG. 1.

FIG. 9 schematically shows an exploded perspective view of an alternate higher load capacity embodiment of a lifting device 910 which may be used to lift concrete elements up to and beyond 50 tonne. In FIG. 9, as well as generally in this description, the reference numerals are allocated by analogy to or prefixed by the figure number; for example FIG. 1 is the "100" series, FIG. 2 is the "200" series and so on. In addition like features between different embodiments of different figures are indicated by like reference numerals, for example the lifting device 110 of FIG. 1 and the alternate lifting device 910 of FIG. 9. The larger capacity lifting device 910 features a longer elongate member 914 and a longer sleeve 926 in order that the wedges 124 and elongate member's flared end 124 may be placed at an increased depth 962 in a concrete element. The larger lifting device 910 also has an increased outside diameter of the flared end 954 of 140 mm. The increased depth 962 to approximately 1200 mm and increased diameter of splaying/outward displacement of the wedges 124 in this example providing the increased load capacity. It will be readily appreciated that considerably higher load capacities up to and beyond 1000 tonne may be readily designed and manufactured in accordance with the invention described herein.

Examples of present application areas may be: present bridge beams up to and beyond 150 tonne may require lifting devices in a product range of up to 500 tonne. Bridge deck elements up to 50 tonne may require a lifting device product range up to 50 tonne. Panels up to 30 tonne may require a lifting device product range of up to 30 tonne. Portable concrete road barriers up to and beyond 10 tonne may require a lifting device product range up to and beyond 10 tonne. However the load capacity of present lifting inserts/anchors, as described in the "Description of the Art" earlier, may be presently limiting the size of concrete elements that may be fabricated which are then required to be lifted and/or handled in some manner. However it will be readily appreciated that the present invention is not constrained by the load limits of the prior art. One such example of an application area of a very large load concrete element may be the concrete legs and floating concrete caisson structures of oil platforms which in present and future forms may require lifts and/or handling up to and possibly beyond 1,000 tonne.

In FIG. 9 the safety cap 134 to the sleeve 926 is not present because it may not be used for a 50 tonne or beyond embodiment of the lifting device 910. In this embodiment the lifting device 910 may also be used as a lifting clutch attached to the crane's rigging between lifts, rather than being disengaged from the crane between lifts as described for the lower load capacity lifting device 110 of FIGS. 1 to 8. The use of the larger lifting device 910 as a lifting clutch may have an advantage over other lifting clutches which rely on a sideways coupling action to a lifting insert and consequently must be manually dragged and coupled by the dagger/rigger. Sideways lifting clutches for lifting concrete elements may be weighty items which in manhandling can increase the risk of back injuries for the dogger/rigger.

Figure 10:
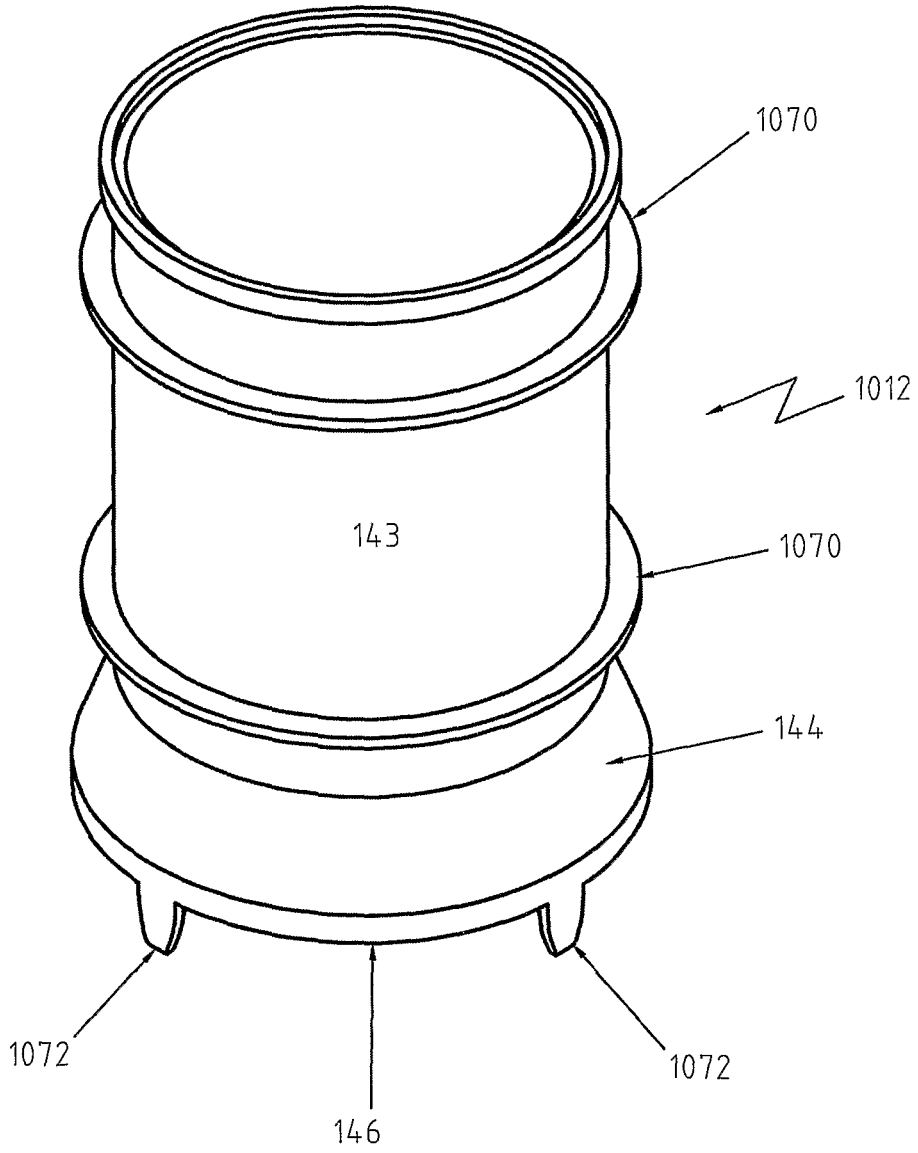
FIG. 10 is a schematic of a perspective view of an alternate embodiment of the cavity former of FIG. 1.

FIG. 10 is a schematic of a perspective view of an alternate cavity former 1012 to that shown in FIG. 1. The cavity former 1012 additionally features circumferential 1070 stiffeners to aid in maintaining the shape of the cavity former 1012 during the casting of the concrete element. The cavity former base 146 may also have spacers 1072 which in assist in correct positioning of the cavity former; described in detail with respect to FIG. 11. The cavity former may be made, for example, of a suitable plastic in a moulding process or may be made of a metal and/or composite so as to act as a cavity former and/or a liner to improve the operation of the lifting device in use. However it will be readily appreciated that other materials may be used for the cavity former, as appropriate to a particular concrete element and lifting application. In addition it will be readily appreciated that transverse cross-sections other than circular for the tube/bore portion (143) of the former may be produced; for example elliptical or to suit a rectangular cross-section edge lifting device as described below with respect to FIGS. 13 and 14.

Figure 11:
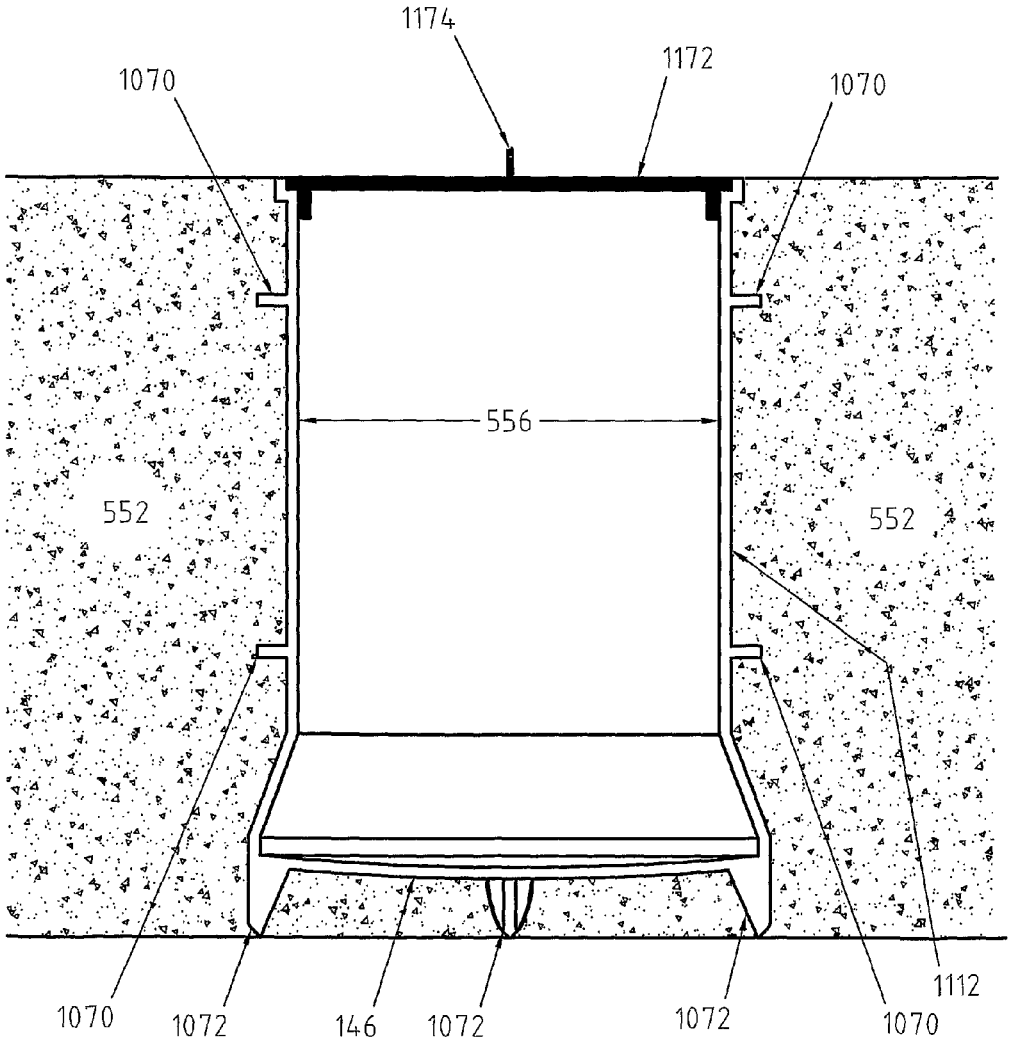
FIG. 11 is a schematic of a cross-sectional view of another alternate embodiment of the cavity former of FIG. 1: cast permanently into a concrete element.

FIG. 11 is a schematic of a cross-sectional view of yet another alternate cavity former 1112. The alternate cavity former 1112 has been cast permanently into a concrete element 552 in the form of a concrete element panel of the same thickness as the height of the cavity former 1112. The spacers 1072 have been used in the casting process to raise the base 146 of the cavity former the appropriate distance from the panel mould's base (not shown) in order to have the necessary coverage of the cavity former's base 146. During the casting a lid 1172 with locating lugs 1174 may be used to prevent concrete entering the cavity former 1112. Alternatively or in addition a support (not shown) of outside diameter appropriate to the inside bore diameter 556 of the cavity former, may be used to provide support to the cavity former during casting.

It will be readily appreciated that alternate forms of the cavity former may be made to allow a cavity to be formed at a shallower angle than the perpendicular to the concrete element surface shown in FIG. 11. The use of a variety of angles for the bore axis of the cavity former to the surface of the concrete element has been described above with respect to FIG. 8.

Figure 12:
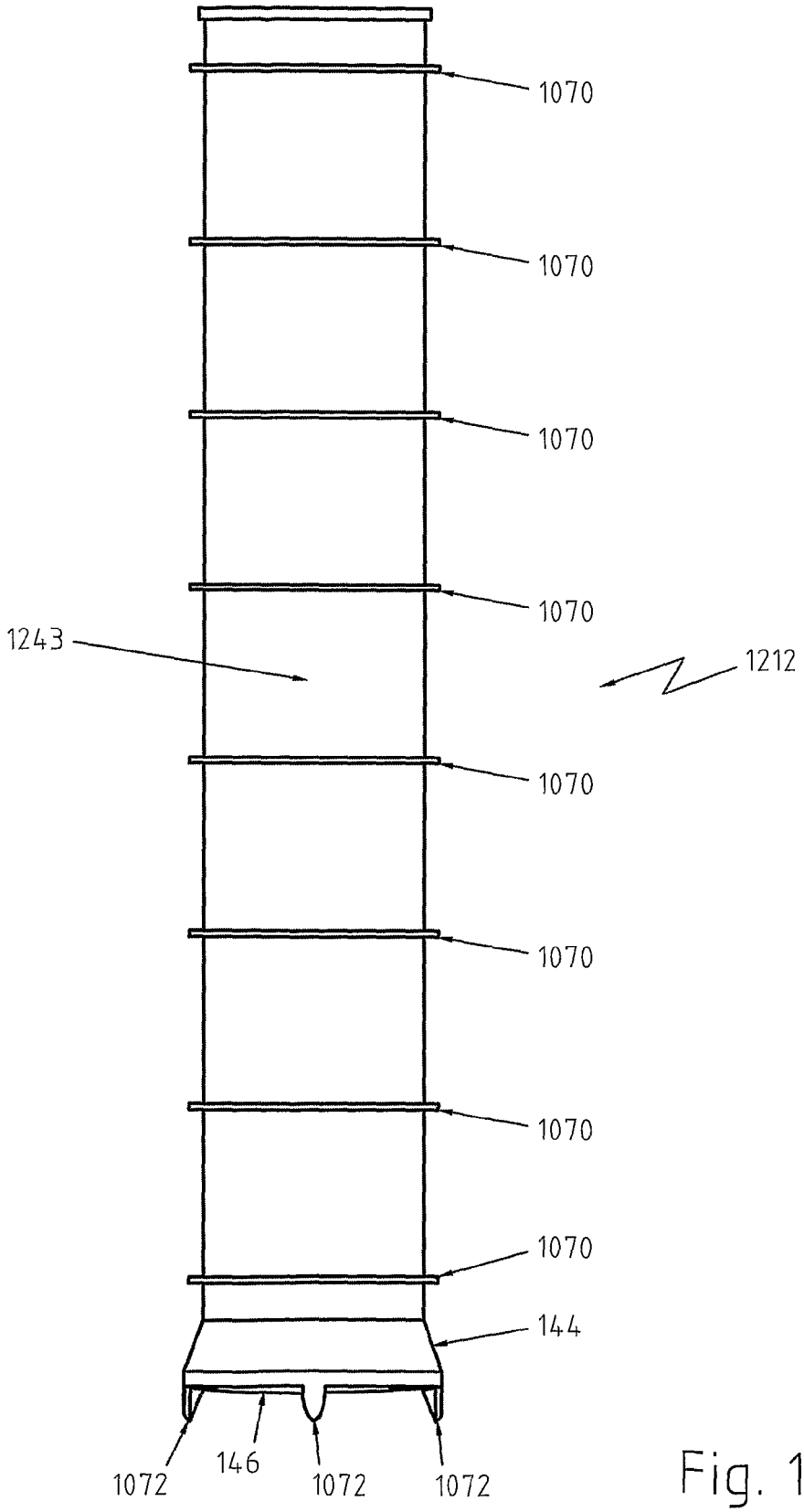
FIG. 12 is a schematic of a cross-sectional view of yet another alternate embodiment of a larger cavity former to that of FIG. 1.

FIG. 12 is a schematic of a cross-sectional view of yet another alternate, larger cavity former 1212 suitable for a lifting device of a higher load capacity than the lifting device 110 illustrated in FIGS. 1 to 8. The larger cavity former 1212 has a longer tube portion 1243 compared with earlier embodiments shown in the figures.

In yet another embodiment a suitably configured cavity may be formed by drilling a hole as a first cavity in a concrete element and then at the base of the hole undercutting it to form a second cavity suitable for the wedges 124 and the elongate member's flared end 122. The upper surface 248 of the wedge may then engage with the walls of the second cavity and/or a junction between the hole bore first cavity and the undercut second cavity. Such a method of forming a configured cavity may be suitable for enabling the lifting device to be applied to concrete elements which previously did not have a cavity, for example portable concrete road barriers where the originally installed lifting insert may not be serviceable.

A further method and technique for forming a configured cavity may be suitable to the lifting of slabs, panels and other concrete structures, particularly in demolition or emergency, rescue work. A through hole may be made by drilling, cutting, percussion means, a jackhammer or otherwise made through a section of a concrete element so that the elongate member's flared end 122 and the wedges 124 may be passed through to the other side of the thickness of the concrete element. The wedges 124 may then brought against the flared end 122 and the upper surface of the wedges 248 brought against the rim of the hole cut in the concrete element to enable a lift to occur.

In the above alternatives for cavity forming it will be readily apparent that the angle 560 need not be the approximate, preferred 30 degrees shown in FIG. 5 and FIGS. 11 and 12 but may be less than 30 degrees and up to 90 degrees. For example the angle 560 may be from 10 to 90 degrees or 20 to 60 degrees or as appropriate to an application and a lifting device. In addition the particular angle chosen may be selected according to the concrete element to be lifted and desired load capacity of the lifting device to be used, as described earlier.

It will also be readily appreciated that the specific profiles of the wedges 124 (or other interference devices), the upper surface 248 of each wedge 124 and the flared end 122 may also be varied as appropriate for the angle selected, the concrete element's weight and the cavity available for the lifting device to be used with. For, example in undercut or through hole applications the corresponding angle 560 at the base of the cavity bore 550 may be approximately 90 degrees but with a degree of chamfering/rounding off/chipping that may require some modification of the upper surface 248 of the wedge 124 and/or the flared end 122 of the elongate member 114 to accommodate such applications. For example the upper surface 248 of the wedge 124 may be more concave and/or the degree of flaring of the flared end 122 may be adjusted. In addition the number of wedges 124 may be varied from the preferred five shown in FIGS. 1 to 9. In some applications one wedge may only be possible due to internal design restrictions for the concrete element, internal reinforcing for example. Two wedges may be preferred for edged lifting devices, described in detail below with respect to FIGS. 13 and 14. In other applications three wedges may be kinematically optimal whilst in others more than 20 wedges may be desirable.

The use of a cavity in the concrete element rather than an embedded lifting insert and/or anchor allows for ready inspection of the cavity's structural integrity (cracking etc) by manual, visual and non-destructive testing techniques. In addition for the life of the concrete element there is no embedded insert or anchor which may corrode or contribute to loss of structural integrity of the concrete element.

Figure 13:
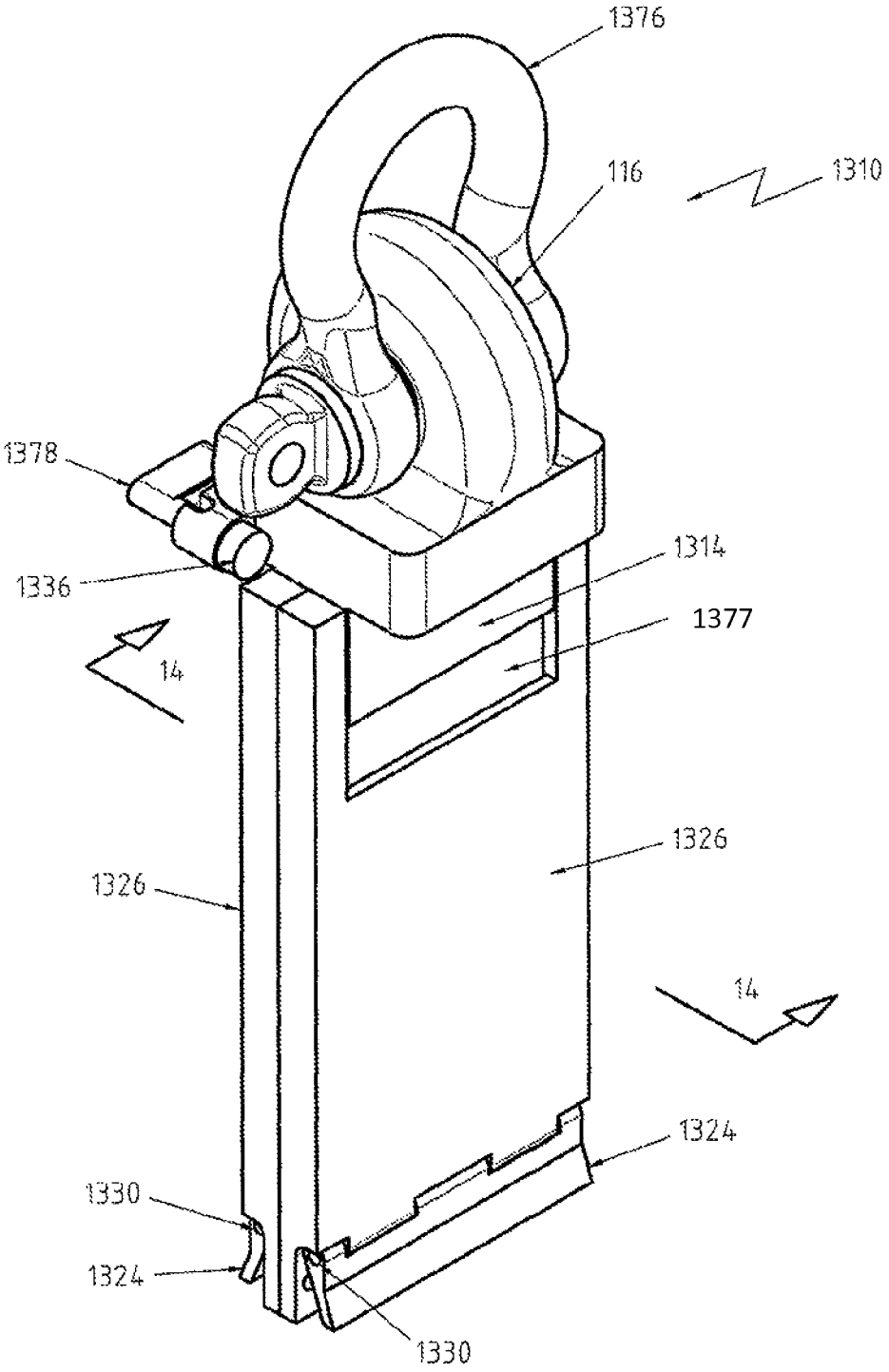
FIG. 13 is a schematic of a perspective/isometric view of an alternate lifting device for edge lifting.

FIG. 13 is a schematic of a perspective/isometric view of an alternate lifting device 1310 suitable for lifting via the edge sides of concrete elements such as panels and slabs. Slabs for floors and panels for walls as well as other concrete elements such as curtain walls are often relatively thin but still weigh many tonnes and as such pose a problem in lifting to a vertical position where one edge of the panel is uppermost. In such applications face lifting via the panel's face may not be able to be used to raise the panel to a vertical position. In addition it may be undesirable to have a hole through the thickness of such thin concrete elements that is suitable for a face lifting device as described earlier. In such situations the edge or end wall of such concrete elements offers an appropriate lifting point as well as a sufficient depth across the plane or the face of the concrete element for tensile and shear edge lifting.

The edge lifting device 1310 has a sleeve 1326 surrounding an elongate member 1314 connected to a lifting eye 116 which in this example has a bow shackle 1376 attached. Moveably attached to the lower end of the sleeve 1326, via terminal lugs 1328 and pivot pins 1330, are two wedges 1324. In an alternate embodiment the number of wedges may be between 1 and 20 as described earlier. The overall shape of the edge lifting device 1310, for the portion that may be inserted into a cavity in the edge of a concrete element, is planar with a rectangular cross-section. For example the sleeve 1326 with elongate member 1314 may have a rectangular cross-section. This overall shape of the inserted portion of the edge lifting device may be to suit the reduced area available for a lifting device on an edge wall of a relatively thin concrete element. In further alternate embodiments of the lifting device the sleeve and/or elongate member may have an elliptical or any suitable cross-section fit for the purpose.

Figure 14:
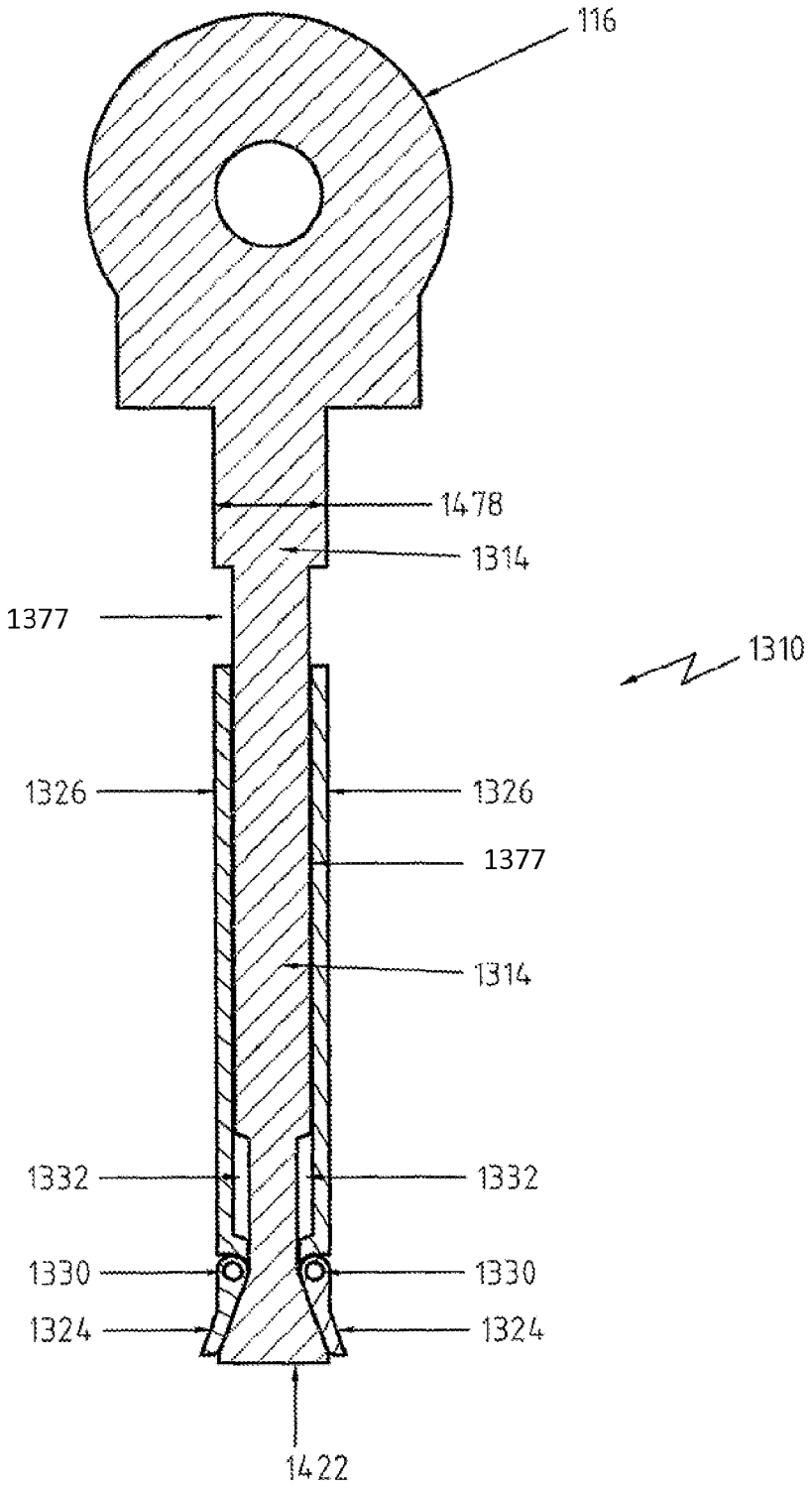
FIG. 14 is a schematic of a cross-sectional view along the line 14-14 of the edge lifting device of FIG. 13.

In FIG. 13 the sleeve 1326 is shown lowered with the wedges 1324 over the elongate member's 1314 flared end (shown in FIG. 14). Visible in FIG. 13 is a section of a second recess 1377 in the elongate member to accommodate the movement of the sleeve 1326, described in detail with respect to FIG. 14. An optional safety element/safety pin 1336 may be provided to prevent the upward movement of the sleeve 1326. In FIG. 13 the safety element/pin 1336 is shown retracted to allow the upward movement of the sleeve 1326 and wedges 1324. The safety pin 1336 may be provided with a controlling handle 1378. In addition a version of the safety cap (not shown) may be applied as required to the edge lifter device 1310.

A suitably shaped cavity for the edge lifting device 1310 may be formed in the edge of a concrete element as described for the other alternate lifting devices used for face lifting of concrete elements. For example a cavity may be formed that is rectangular or approximately rectangular in transverse cross-section to suit an edge lifter.

FIG. 14 is a schematic of a cross-sectional view along the line 14-14 of FIG. 13 of the edge lifting device 1310. The second recess 1377 in the rectangular elongate member 1314 extends to the first recess 1332 that accommodates the wedges 1324 as per the face lifting device 110, 910 described above. The second recess 1377 accommodates the movement of the sleeve 1326 within the greatest width 1478 of the elongate member 1314. The operation and use of the edge lifting device 1310 is as per that described for the face lifting device above, allowing for the application of the edge lifting device to the edges of concrete elements.

Figure 15:
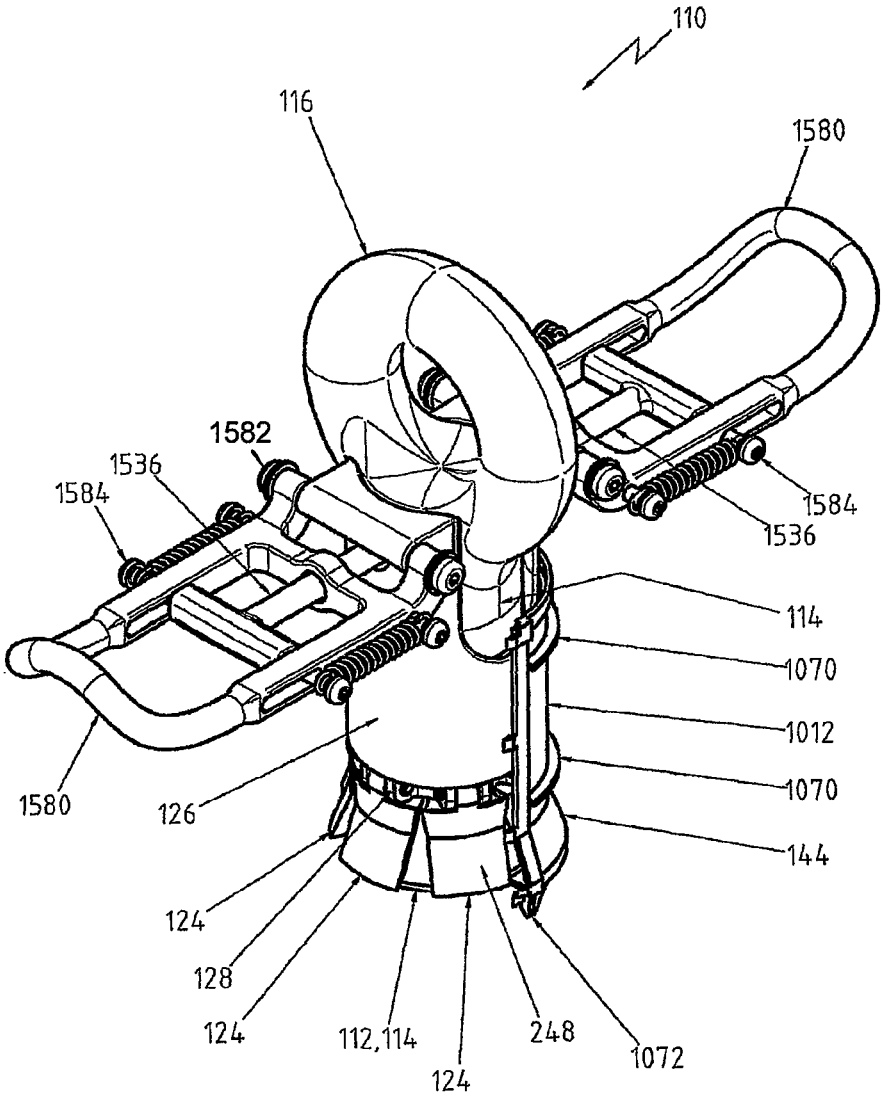
FIG. 15 is a schematic of a part-sectional, perspective view of a lifting device with optional handle.

FIG. 15 is a schematic of a part sectional, perspective view of an alternate embodiment of a face lifting device with two optional handles 1580. The handles 1580 may be attached to either side of the upper end of the sleeve 126 as an aid to inserting, positioning and/or withdrawing the lifting device into a cavity within a concrete element. Alternatively only one handle 1580 may be attached to the lifting device. The handle 1580 may be attached to the sleeve 126 by a hinge mechanism 1582 that allows for the handle/s to be in the position shown in FIG. 15 or raised. The handle/s 1580 may also feature an optional safety pin 1536 that may be incorporated into the handle with a safety pin mechanism 1584.

The applications that the face and edge lifting devices described above may be applied to include:

- Lifting required in the casting stages of concrete elements, for example: demoulding and lifting to curing stations.
- Lifting and handling of concrete elements from casting to on-site construction.

Demolition and emergency rescue work where irregular concrete structures must be moved without pre-existing lifting inserts.

As a lifting clutch.

Portable concrete road barriers.

Concrete legs and floating concrete caisson structures of oil platforms at sea.

Although the invention has been herein shown and described in what is conceived to be the most practical and preferred embodiments, it is recognized that departures can be made within the scope of the invention, which are not to be limited to the details described herein but are to be accorded the full scope of the appended claims so as to embrace any and all equivalent assemblies, devices and apparatus.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise, comprised and comprises" where they appear.

It will further be understood that any reference herein to known prior art does not, unless the contrary indication appears, constitute an admission that such prior art is commonly known by those skilled in the art to which the invention relates.

The invention claimed is:

1. A lifting device for a concrete element comprising:

an elongate member with a flared lower end and an upper end configured for an attachment means;

a sleeve configured to slidably receive the upper end of the elongate member and having one or more wedges pivotably attached to a lower end of the sleeve, the one or more wedges each comprising an upper surface and an opposing lower surface;

wherein the lifting device is configured for manual transformation between:

an insertion configuration whereby the sleeve is raised blocking use of the attachment means and the one or more wedges pivotably attached is positioned at least partially within a recess provided along the elongate member to thereby permit the elongate member and the lower end of the sleeve to be inserted into and removed from a bore formed in the concrete element; and a lifting configuration whereby the sleeve is fully descended unblocking the attachment means and causing the one or more pivotably attached wedges to gradually splay outward by engaging the flared lower end of the elongate member and the upper surface of the one or more wedges is moved into engagement with a flared end wall of a frustoconical end portion of the bore to secure the lifting device to the concrete element; and a safety element for locking the sleeve to the elongate member in the lifting configuration.

2. The lifting device according to claim 1, wherein the attachment means comprises a lifting eye, a lifting ring, a shackle bolt, a hook, a cable or a loop.

3. The lifting device according to claim 1, wherein the flared end is a frustoconical cone.

4. The lifting device according to claim 1 wherein a cross-section of the sleeve has a shape selected from one of cylindrical, elliptical, and rectangular.

5. The lifting device according to claim 1 wherein the elongate member and the sleeve are configured to receive the safety element when one or more wedges is positioned over a portion of the flared end of the elongate member.

6. The lifting device according to claim 1 wherein an upper end of the sleeve is configured to prevent use or access of the attachment means when the wedges are not over a portion of the flared lower end of the elongated member.

7. A method for lifting concrete elements comprising the steps of:

using a lifting device comprising:

an elongate member with a flared lower end and an upper end configured for an attachment means;

a sleeve configured to slidably receive the upper end of the elongate member and having one or more wedges pivotably attached to a lower end of the sleeve, the one or more wedges each comprising an upper surface and an opposing lower surface;

wherein the lifting device is configured for manual transformation between:

an insertion configuration whereby the sleeve is raised and the one or more wedges rest at least partially within a recess provided along the elongate member to thereby permit the elongate member and the lower end of the sleeve to be inserted into and removed from a bore formed in the concrete element; and a lifting configuration whereby as the sleeve is descended the one or more pivotably attached wedges are caused to gradually splay outward by engaging the flared lower end of the elongate member and the upper surface of the one or more wedges is moved into engagement with a flared end wall of a frustoconical end portion of the bore;

securing the lifting device to a concrete element comprising the steps of:

configuring a cavity in the concrete element to receive the lower end of the lifting device;

inserting the lower end of the lifting device into the cavity; and causing one or more wedges at the lower end of the lifting device to engage a flared end of an elongate member of the lifting device and a portion of a wall or an edge of the configured cavity;

preventing lifting of the concrete element until the lifting device is secured to the concrete element;

inserting a safety element into the sleeve to lock it into the lifting configuration;

attaching a lifting machine to the lifting device; and lifting the concrete element.

8. The method for lifting concrete elements according to claim 7 further comprising the steps of:

attaching or inserting the safety element to the lifting device where the safety element prevents the removal of the lifting device from the configured cavity of the concrete element; and preventing attaching of the lifting machine to the lifting device until the lifting device is secured to the concrete element.

* * * * *